US010268153B2

(12) United States Patent
Kamisaki et al.

(10) Patent No.: US 10,268,153 B2
(45) Date of Patent: Apr. 23, 2019

(54) IMAGE FORMING APPARATUS

(71) Applicant: FUJI XEROX CO., LTD., Tokyo (JP)

(72) Inventors: Makoto Kamisaki, Kanagawa (JP); Manabu Furuki, Kanagawa (JP); Naoki Ota, Kanagawa (JP); Tatsuhiro Igarashi, Kanagawa (JP); Yasuhisa Morooka, Kanagawa (JP); Jun Sekiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 42 days.

(21) Appl. No.: 15/650,322

(22) Filed: Jul. 14, 2017

(65) Prior Publication Data

US 2018/0275596 A1 Sep. 27, 2018

(30) Foreign Application Priority Data

Mar. 23, 2017 (JP) ..... 2017-058243

(51) Int. Cl.

| | |
|---|---|
| ***G03G 21/00*** | (2006.01) |
| ***G03G 9/097*** | (2006.01) |
| ***G03G 9/08*** | (2006.01) |

(52) U.S. Cl.

CPC ..... *G03G 21/0029* (2013.01); *G03G 9/0819* (2013.01); *G03G 9/0827* (2013.01); *G03G 9/09708* (2013.01); *G03G 9/09716* (2013.01); *G03G 9/09725* (2013.01); *G03G 9/09733* (2013.01); *G03G 9/09791* (2013.01); *G03G 21/0011* (2013.01)

(58) Field of Classification Search

CPC ..... G03G 9/09725; G03G 15/0189; G03G 15/095

See application file for complete search history.

(56) References Cited

U.S. PATENT DOCUMENTS

| | | | | |
|---|---|---|---|---|
| 2007/0104500 | A1* | 5/2007 | Nagata | G03G 15/0894 399/45 |
| 2012/0094230 | A1* | 4/2012 | Sakoh | G03G 9/0827 430/111.4 |
| 2012/0213546 | A1* | 8/2012 | Kawamata | G03G 15/161 399/101 |

(Continued)

FOREIGN PATENT DOCUMENTS

| | | | |
|---|---|---|---|
| JP | 2001-183951 | A | 7/2001 |
| JP | 2009-069799 | A | 4/2009 |
| JP | 2012-155178 | A | 8/2012 |

*Primary Examiner* — Peter L Vajda

(74) *Attorney, Agent, or Firm* — Oliff PLC

(57) ABSTRACT

An image forming apparatus includes an image forming unit including an image carrier, a developing device that includes a developer containing a toner, and a cleaning device including a blade; and a transfer device. The toner contains toner particles having a volume-average particle size of 3 μm or more and 5 μm or less, a spherical inorganic external additive having a number-average particle size of 80 nm to 200 nm, and an organic component. In the cleaning device, an external additive residue in or near a contact region between the image carrier and the blade contains the organic component and an inorganic component, the area ratio of the organic component to the inorganic component is 3/7 or more and 7/3 or less, and the area ratio of the inorganic component that is spherical to the external additive residue is 30% or more.

9 Claims, 6 Drawing Sheets

(56) References Cited

U.S. PATENT DOCUMENTS

| | | | | |
|---|---|---|---|---|
| 2014/0119769 | A1* | 5/2014 | Kikuchi | G03G 15/0233 399/100 |
| 2015/0071671 | A1* | 3/2015 | Kiuchi | G03G 15/5062 399/72 |

* cited by examiner

IMAGE FORMING APPARATUS

CROSS-REFERENCE TO RELATED APPLICATIONS

This application is based on and claims priority under 35 USC 119 from Japanese Patent Application No. 2017-058243 filed Mar. 23, 2017.

BACKGROUND

(i) Technical Field

The present invention relates to an image forming apparatus.

(ii) Related Art

Processes of making image information visible such as the electrophotographic process are currently used in various fields. In the electrophotographic process, for example, an image carrier is charged and an electrostatic image is formed as image information on the surface of the image carrier. Subsequently, for example, a developer containing a toner is used to form a toner image on the surface of the image carrier. This toner image is transferred onto a recording medium. The toner image is then fixed on the recording medium. These steps are performed to convert image information into a visible image. The image carrier is cleaned, for example, before formation of another toner image, with a cleaning member such as a blade.

SUMMARY

According to an aspect of the invention, there is provided an image forming apparatus including:

an image forming unit including an image carrier, a developing device that includes a developer containing a toner and that develops, with the developer, an electrostatic latent image on the image carrier to form a toner image, and a cleaning device including a blade that cleans a residual toner off the image carrier; and a transfer device that transfers the toner image formed on the image carrier onto a recording medium, wherein the toner contains toner particles having a volume-average particle size of 3 μm or more and 5 μm or less and a spherical inorganic external additive having a number-average particle size of 80 nm to 200 nm, and an organic component, in the cleaning device, an external additive residue in or near a contact region between the image carrier and the blade contains the organic component and an inorganic component, an area ratio of the organic component to the inorganic component is 3/7 or more and 7/3 or less and an area ratio of the inorganic component that is spherical to the external additive residue is 30% or more.

BRIEF DESCRIPTION OF THE DRAWINGS

Exemplary embodiments of the present invention will be described in detail based on the following figures, wherein.

DETAILED DESCRIPTION

Figure 1:
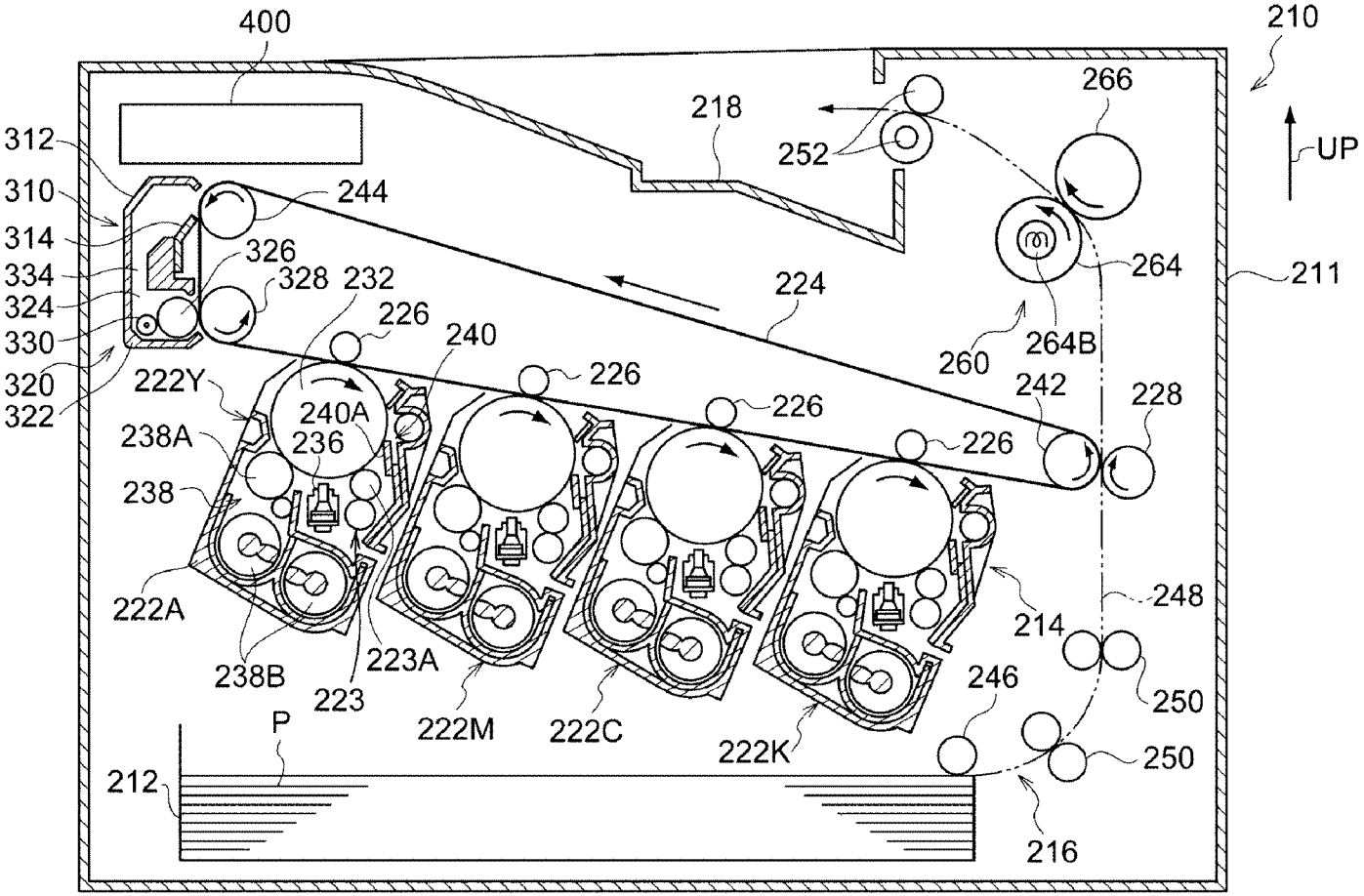
FIG. 1 is a schematic view illustrating the configuration of an image forming apparatus according to an exemplary embodiment.

Hereinafter, exemplary embodiments that are examples according to the present invention will be described in detail.

An image forming apparatus according to an exemplary embodiment includes an image forming unit including an image carrier, a developing device that includes a developer containing a toner and that develops, with the developer, an electrostatic latent image on the image carrier to form a toner image, and a cleaning device including a blade that cleans a residual toner off the image carrier; and a transfer device that transfers the toner image formed on the image carrier onto a recording medium.

The toner contains toner particles having a volume-average particle size of 3 μm or more and 5 μm or less, a spherical inorganic external additive having a number-average particle size of 80 nm to 200 nm, and an organic component.

In the cleaning device, an external additive residue (hereafter, sometimes referred to as an "external additive dam") in or near a contact region between the image carrier and the blade contains the organic component and an inorganic component, the area ratio of the organic component to the inorganic component (organic component/inorganic component) is 3/7 or more and 7/3 or less, and the area ratio of the inorganic component that is spherical to the external additive dam (the external additive residue) is 30% or more.

In these years, in order to provide high-resolution images, developers used for electrophotographic image forming apparatuses have been studied toward a reduction in the size of toner particles and carriers. However, such toner particles having a small diameter exhibit high adhesion, which tends to result in low fluidity and a low capability of being transferred from a member such as an image carrier. For this reason, in order to provide a buffer function (spacer function) between toner particles or between toner particles and a member such as an image carrier, an external additive having a large particle size tends to be used.

From the viewpoint of what is described above, a developer containing a toner containing toner particles having a volume-average particle size of 3 μm or more and 5 μm or less and an external additive having a number-average particle size of 80 nm or more and 200 nm or less is suitable for ensuring a sufficiently high capability of being transferred and for forming high-resolution images.

However, when toner particles having a small size are employed, the amount of toner consumed decreases, so that the toner within the container of the developing device is less likely to be replaced. Thus, the time for which the same toner remains within the developing device increases, so that the same toner tends to be kept under mechanical and thermal loads. In particular, when an image having a low area coverage (for example, an image having an area coverage of 5% or less) is repeatedly formed in an environment at a high temperature and a high humidity (for example, in an environment at 30° C. or more and 80% RH or more), the amount of toner consumed further decreases, to thereby increase the tendency of keeping the same toner under mechanical and thermal loads. As a result, the mechanical and thermal loads tend to cause the external additive to be embedded in the toner particles.

In addition, a decrease in the size of toner particles tends to result in an increase in the amount of external additive per unit area of the toner particles. This further increases the tendency of causing the external additive to be embedded in the toner particles due to the mechanical load.

Specifically, in the developing device, the developer contained in the container is circulated in the following manner: the developer being stirred in the container by a stirring-transport member is transported from the container and carried on the surface of the developer carrier, and returned to the container. At this time, the developer is subjected to a stirring force due to the stirring-transport member and a regulation force due to a layer-thickness regulation member for regulating the thickness of the developer layer carried on the surface of the developer carrier. When the same developer remains within the developing device, it is repeatedly subjected to a mechanical load due to the stirring force and the regulation force. As a result, the external additive tends to be embedded in the toner particles.

Thus, in addition to a decrease in the amount of toner supplied to the contact region between the image carrier and the blade, the external additive is less likely to become separated from the toner particles in the contact region between the image carrier and the blade, which results in a decrease in the amount of external additive dam. In this case, the image carrier and the blade have therebetween some regions with increased coefficients of friction, so that the position of the blade with respect to the image carrier becomes unstable. As a result, local wear may be caused in the blade.

From the viewpoint of what is described above, an image forming apparatus according to this exemplary embodiment is provided with the following features: an external additive dam (external additive residue) remaining in the contact region between the image carrier and the blade contains an organic component and an inorganic component, the area ratio of the organic component to the inorganic component (organic component/inorganic component) is 3/7 or more and 7/3 or less, and the area ratio of the inorganic component that is spherical to the external additive dam is 30% or more. When the external additive dam is provided so as to satisfy these conditions, even in the case of repeated formation of an image having a low area coverage in an environment at a high temperature and a high humidity, an increase in the coefficient of friction in some regions between the image carrier and the blade is suppressed and instability of the position of the blade with respect to the image carrier is suppressed.

As a result, the image forming apparatus according to this exemplary embodiment enables suppression of the "local wear in the blade for the image carrier", which occurs during repeated formation of an image having a low area coverage in an environment at a high temperature and a high humidity.

In the image forming apparatus according to this exemplary embodiment, the "area ratio of the organic component to the inorganic component (organic component/inorganic component)" in the external additive dam, which is 3/7 or more and 7/3 or less, is preferably 2/3 or more and 3/2 or less, from the viewpoint of suppression of local wear in the blade for the image carrier.

The area ratio of the inorganic component that is spherical to the external additive dam, which is 30% or more, is preferably 40% or more, from the viewpoint of suppression of local wear in the blade for the image carrier. However, the area ratio of the inorganic component that is spherical to the external additive dam is preferably 70% or less from the viewpoint of suppression of escape of the inorganic component through the blade from the external additive dam holding an excessively large amount of inorganic component and suppression of contamination of the charging roller caused by the escape.

In the external additive dam, examples of the organic component include a lubricant, resin particles as an external additive of the toner, and free oil derived from oil-treated silica as an external additive of the toner. Of these, the organic component preferably contains a lubricant. Incidentally, the lubricant may be added as an external additive (for example, particles of a metallic salt of a fatty acid) to the toner, to thereby be used as a source of an organic component supplied to the external additive dam. Alternatively, a lubricant supply device (for example, a device having a brush member that rotates to shave off a lubricant and make the lubricant adhere to the surface of the image carrier) disposed in a region around the image carrier may be used to supply the lubricant and used as a source of an organic component supplied to the external additive dam.

On the other hand, examples of the inorganic component include inorganic particles (for example, silica particles, titania particles, or alumina particles) as external additives for the toner. Of these, the inorganic component preferably contains silica particles.

Herein, the term "inorganic component that is spherical" means the inorganic component that has a circularity of 0.85 or more.

The circularity is determined on the basis of image analysis of a primary particle observed with a SEM apparatus, and obtained as "100/SF2", which is calculated by the following formula.

$$\text{circularity}(100/SF2)=4\pi\times(A/I^2) \qquad \text{Formula:}$$

where I is the peripheral length of a primary particle on the image, and A is the projected area of the primary particle.

The "area ratio of the organic component to the inorganic component (organic component/inorganic component)" in the external additive dam, and the "area ratio of the inorganic component that is spherical to the external additive dam" are values measured in the following manner.

A developer containing a new toner (unused toner) and a carrier is first charged into the container of the developing device of an image forming apparatus. In the case of employing an image forming apparatus to which a toner cartridge is attached, a toner cartridge containing the same new toner is attached to the image forming apparatus.

Figure 7:
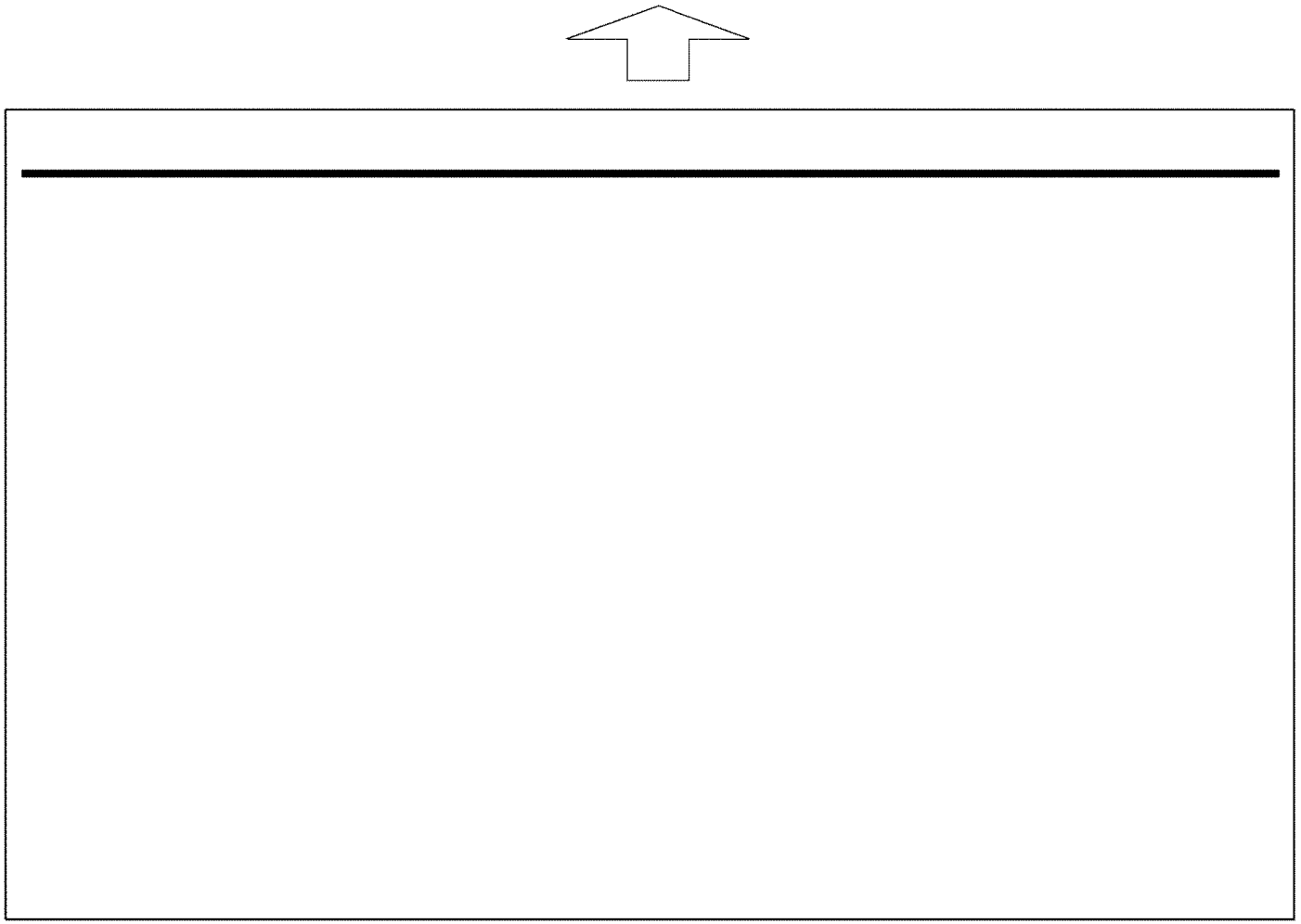
FIG. 7 is a schematic view of an image pattern formed before measurements of area ratios of an external additive dam.

In this state, in an environment at a high temperature and a high humidity (environment at 30° C. and 85% RH), an image having a pattern in FIG. 7 (image pattern of a single line) is output with a toner application amount of 3.5 g/m$^2$ and an area coverage of 1% on 1000 sheets of A4-size paper.

Incidentally, this image formation corresponds to, in a case where the image forming apparatus includes plural image forming units (for example, a tandem-system image forming apparatus), image formation performed by a single image forming unit. In a case where an image forming unit includes plural developing devices (for example, an image forming unit including rotary-type developing devices), the image formation corresponds to image formation performed by a single developing device.

Incidentally, the area coverage is a ratio of the area of an image formed to the area of a surface (on which the image is formed) of a paper sheet (an example of the recording medium). In FIG. 7, the arrow represents a direction in which the A4-size paper is fed.

After the image is formed, an external additive dam remaining in the contact region between the image carrier and the blade is sampled.

Subsequently, the sampled external additive dam is observed with a scanning electron microscope (SEM) at a magnification of 10000, and an observation image is obtained. The observation image is obtained such that the whole image is occupied by the external additive dam. The observation image is subjected to image analysis using a binarizing process, to identify the organic component and the inorganic component. For example, when the organic component is a lubricant and the inorganic component is silica particles, the organic component looks dark, while the inorganic component looks light. The contrast between these components (the difference between the dark and the light) is utilized in the binarizing process for image analysis of the observation image, to thereby identify the organic component and the inorganic component. The areas of the organic component region and the inorganic component region thus identified are determined, and the area ratio therebetween is calculated. This procedure is repeated 10 times, and the resultant area ratios are averaged to obtain the "area ratio of the organic component to the inorganic component (organic component/inorganic component)".

On the other hand, the observation image is subjected to image analysis to determine, in the inorganic component, the area of the inorganic component that is spherical, and the area ratio of the inorganic component that is spherical to the observation image is calculated. This procedure is repeated 10 times, and the resultant area ratios are averaged to obtain the "area ratio of the inorganic component that is spherical to the external additive dam".

Regarding the image forming apparatus according to this exemplary embodiment, examples in which the "area ratio of the organic component to the inorganic component (organic component/inorganic component)" in the external additive dam and the "area ratio of the inorganic component that is spherical to the external additive dam" satisfy the above-described ranges (examples in which these area ratios tend to be maintained within the above-described ranges) will be described below. Hereafter, these area ratios are sometimes referred to as the "conditions of the external additive dam".

Example (1)

The image forming apparatus according to this exemplary embodiment may have a configuration in which the blade has a recess that receives the external additive, the recess being, in a tip surface of the blade, at a surface portion that is not in contact with the image carrier but partially comes into contact with the image carrier when a contact area of the blade with respect to the image carrier increases.

In the image forming apparatus according to Example (1), the conditions of the external additive dam tend to be maintained, so that the "local wear in the blade for the image carrier", which occurs during repeated formation of an image having a low area coverage in an environment at a high temperature and a high humidity, tends to be suppressed. This is probably achieved by the following mechanism.

Figure 2A:
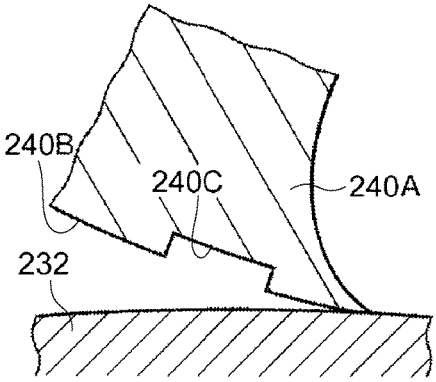
FIGS. 2A and 2B are schematic views illustrating the behavior of a blade of a photoconductor cleaning device in an image forming apparatus according to an exemplary embodiment.

When such a recess that receives the external additive is formed at the above-described portion in the tip surface of the blade, and a toner image having a normal area coverage (for example, an area coverage of more than 5%) is formed on the image carrier, a large amount of residual toner reaches the contact region between the image carrier and the blade. As a result, when the residual toner is cleaned off with the blade, the external additive separated from the toner particles is received in the recess of the blade (refer to FIG. 2A).

On the other hand, when an image having a low area coverage (for example, an area coverage of 5% or less) is repeatedly formed in an environment at a high temperature and a high humidity, the amount of external additive dam decreases; as a result, the image carrier and the blade have therebetween some regions with increased coefficients of friction; and, in these regions, a phenomenon (what is called, tacking) occurs in which the contact area of the blade with respect to the image carrier increases in the peripheral direction of the image carrier.

Figure 2B:
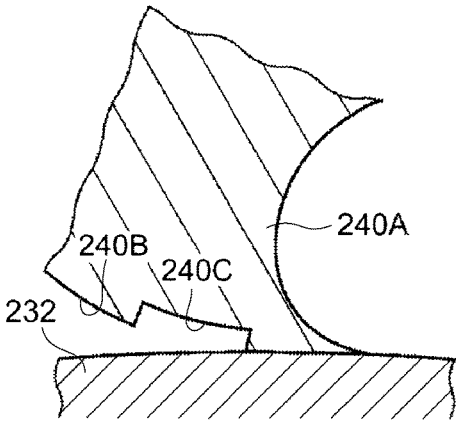

However, when the external additive is received in the recess formed at the above-described portion in the tip surface of the blade, at the time of an increase in the contact area of the blade with respect to the image carrier, the recess is displaced to a position so as to face the surface of the image carrier. Thus, the external additive received in the recess is supplied to the contact region between the image carrier and the blade (refer to FIG. 2B). As a result, the conditions of the external additive dam (the area ratio of the organic component to the inorganic component, and the area ratio of the inorganic component that is spherical to the external additive dam) tend to be maintained. Thus, the increased coefficient of friction between the image carrier and the blade decreases, and the increased contact area of the blade with respect to the image carrier decreases. As a result, the instability of the position of the blade with respect to the image carrier is resolved.

Probably because of the above-described mechanism, in the image forming apparatus according to Example (1), the conditions of the external additive dam tend to be maintained, and the "local wear in the blade for the image carrier", which occurs during repeated formation of an image having a low area coverage in an environment at a high temperature and a high humidity, tends to be suppressed.

Example (2)

The image forming apparatus according to this exemplary embodiment may have a configuration in which the transfer device includes an intermediate transfer member onto a surface of which the toner image is transferred; a first transfer part that performs first transfer of transferring the toner image formed on a surface of the image carrier of the image forming unit, onto the surface of the intermediate transfer member; and a second transfer part that performs second transfer of transferring the toner image transferred onto the surface of the intermediate transfer member, onto a surface of the recording medium, and the image forming apparatus further includes:

an intermediate-transfer-member cleaning device that cleans a residual toner off the intermediate transfer member, a toner supply device including a container that stores the residual toner from the intermediate transfer member, and a supply section that supplies the residual toner stored in the container to the contact region between the image carrier and the blade in the image forming unit, and a controller that controls a supply operation of the toner supply device when a toner image having a predetermined area coverage or less is formed on the image carrier of the image forming unit.

In the image forming apparatus according to Example (2), the residual toner cleaned off by the intermediate-transfer-member cleaning device is stored in the container of the toner supply device. When a toner image having a predetermined area coverage or less is formed on the image carrier, the residual toner stored in the container of the toner supply device is supplied to the contact region between the image carrier and the blade in the image forming unit.

Thus, even in the case of repeated formation of an image having a low area coverage (for example, an area coverage of 5% or less) in an environment at a high temperature and a high humidity, the conditions of the external additive dam (the area ratio of the organic component to the inorganic component, and the area ratio of the inorganic component that is spherical to the external additive dam) tend to be maintained. As a result, an increase in the coefficient of friction between the image carrier and the blade is suppressed, so that instability of the position of the blade with respect to the image carrier is suppressed.

Probably because of the above-described mechanism, in the image forming apparatus according to Example (2), the conditions of the external additive dam tend to be maintained, and the "local wear in the blade for the image carrier", which occurs during repeated formation of an image having a low area coverage in an environment at a high temperature and a high humidity, tends to be suppressed.

The image forming apparatus according to Example (2) may have a configuration in which the image forming unit includes plural image forming units, and the controller controls a supply operation of the toner supply device when a toner image having a predetermined area coverage or less is formed on the image carrier of at least one image forming unit of the plural image forming units.

In other words, the image forming apparatus according to Example (2) may include a single image forming unit, or may include plural image forming units.

The image forming apparatus according to Example (2) may have a configuration in which the toner supply device includes a supply part that supplies the residual toner to the intermediate transfer member, and the controller performs control such that, during the formation of a toner image having a predetermined area coverage or less on the image carrier of the image forming unit, the residual toner in the toner supply device is supplied onto the intermediate transfer member and is moved from the intermediate transfer member to the image carrier of the image forming unit.

Incidentally, the image forming apparatus according to Example (2) is not limited to an apparatus in which the residual toner stored in the container of the toner supply device is supplied onto the intermediate transfer member, is moved from the intermediate transfer member to the image carrier of the image forming unit, and is supplied to the contact region between the image carrier and the blade in the image forming unit. For example, the image forming apparatus according to Example (2) may be an apparatus in which the residual toner stored in the container of the toner supply device is directly applied to, without using the intermediate transfer member, the image carrier of the image forming unit, and is supplied to the contact region between the image carrier and the blade in the image forming unit; or may be an apparatus in which the residual toner stored in the container of the toner supply device is directly supplied to, without using the intermediate transfer member or the image carrier, the contact region between the image carrier and the blade in the image forming unit.

However, the image forming apparatus according to Example (2) may be, from the viewpoint of suppression of an increase in the size of the apparatus, an apparatus in which the residual toner stored in the container of the toner supply device is supplied onto the intermediate transfer member, is moved from the intermediate transfer member to the image carrier of the image forming unit, and is supplied to the contact region between the image carrier and the blade in the image forming unit.

In summary, the image forming apparatus according to Example (1) uses the external additive received in advance in the recess in the tip surface of the blade; and the image forming apparatus according to Example (2) uses the residual toner collected during cleaning of the intermediate transfer member.

Thus, in the image forming apparatuses according to Examples (1) and (2), compared with an image forming apparatus in which a strip-shaped toner image is formed on an image carrier to thereby supply the toner to the contact region between the image carrier and a blade, the amount of toner consumed is reduced and the "local wear in the blade for the image carrier", which occurs during repeated formation of an image having a low area coverage in an environment at a high temperature and a high humidity, tends to be suppressed.

The image forming apparatus according to this exemplary embodiment is applicable to well-known image forming apparatuses, such as a tandem-system apparatus including plural image forming units; an apparatus including a rotary-type image forming unit including plural developing devices; a direct-transfer-system apparatus in which a toner image formed on the surface of an image carrier of an image forming unit is directly transferred onto a recording medium; an intermediate-transfer-system apparatus in which a toner image formed on the surface of an image carrier of an image forming unit is subjected to first transfer onto the surface of an intermediate transfer member, and the toner image transferred onto the surface of the intermediate transfer member is subjected to second transfer onto the surface of a recording medium; and an apparatus including a discharging device that applies discharging light to the surface of an image carrier after transfer of a toner image and before charging of the image carrier, to thereby discharge the charged surface.

In the case of an intermediate-transfer-system apparatus, the transfer device includes, for example, an intermediate transfer member onto the surface of which a toner image is transferred, a first transfer device that performs first transfer of transferring the toner image formed on the surface of the image carrier onto the surface of the intermediate transfer member, and a second transfer device that performs second transfer of transferring the toner image transferred onto the surface of the intermediate transfer member, onto the surface of a recording medium.

In the case of an intermediate-transfer-system apparatus including plural image forming units, the apparatus includes, as the transfer device, plural first transfer devices that transfer toner images formed on image carriers of plural image forming units onto an intermediate transfer member.

Incidentally, in the image forming apparatus according to this exemplary embodiment, for example, a part at least including the image carrier may be provided as a cartridge structure (process cartridge) that is detachably attached to the image forming apparatus.

Hereinafter, an example of the image forming apparatus according to this exemplary embodiment will be described; however, the image forming apparatus is not limited to this example. Incidentally, several components in FIG. 1 will be described below, but redundant descriptions will be omitted. In FIG. 1, the arrow UP denotes an upward vertical direction.

As illustrated in FIG. 1, an image forming apparatus 210 includes an image forming apparatus body 211, which houses components. The image forming apparatus body 211 houses a storage section 212, which stores recording media P such as paper sheets; an image forming section 214, which forms an image on the recording media P; and a transport section 216, which transports recording media P from the storage section 212 to the image forming section 214. In addition, the image forming apparatus body 211 has, in an upper portion thereof, an output section 218, which outputs recording media P on which an image is formed by the image forming section 214. In addition, the image forming apparatus body 211 houses a controller 400, which controls operations of components in the image forming apparatus 210.

The image forming section 214 includes image forming units 222Y, 222M, 222C, and 222K (hereafter, referred to as 222Y to 222K), which form color toner images of yellow (Y), magenta (M), cyan (C), and black (K); an intermediate transfer belt 224 (an example of the intermediate transfer member), onto which the toner images formed in the image forming units 222Y to 222K are transferred; first transfer rollers 226 (an example of the first transfer part), which transfer the toner images formed in the image forming units 222Y to 222K onto the intermediate transfer belt 224; and a second transfer roller 228 (an example of the second transfer part), which transfers the toner images transferred by the first transfer rollers 226 onto the intermediate transfer belt 224, from the intermediate transfer belt 224 onto the recording media P.

A unit constituted by the intermediate transfer belt 224, the first transfer rollers 226, and the second transfer roller 228 corresponds to an example of the transfer device.

Incidentally, the image forming section 214 is not limited to the above-described configuration, and may have another configuration as long as an image is formed on recording media P.

The image forming units 222Y to 222K are arranged in a central portion (in the vertical direction) of the image forming apparatus 210 so as to incline with respect to the horizontal direction. The image forming units 222Y to 222K each include a photoconductor 232 (an example of the image carrier), which rotates in a single direction (for example, in the clockwise direction in FIG. 1). Incidentally, since the image forming units 222Y to 222K all have a similar configuration, in FIG. 1, reference signs for components of the image forming units 222M, 222C, and 222K are omitted.

Around each photoconductor 232, the following components are sequentially provided from the upstream side (in the rotation direction) of the photoconductor 232: a charging device 223 including a charging roller 223A, which charges the photoconductor 232; an exposure device 236, which exposes, to light, the photoconductor 232 charged with the charging device 223 to form an electrostatic latent image on the photoconductor 232; a developing device 238, which develops the electrostatic latent image formed on the photoconductor 232 by the exposure device 236, to form a toner image; and a photoconductor cleaning device 240, which cleans off the residual toner remaining on the photoconductor 232.

In a region around the intermediate transfer belt 224, the following components are provided on the downstream side (in the rotation direction) of the intermediate transfer belt 224 with respect to the position where the second transfer roller 228 is disposed: an intermediate-transfer-belt cleaning device 310 (an example of the intermediate-transfer-member cleaning device), which cleans the residual toner off the intermediate transfer belt 224; and a toner supply device 320, which supplies the residual toner cleaned off by the intermediate-transfer-belt cleaning device 310, to the contact region between the photoconductor 232 and a blade 240A of at least one image forming unit among the image forming units 222Y to 222K.

The photoconductor 232, the charging device 223, the exposure device 236, the developing device 238, and the photoconductor cleaning device 240 are held together by the housing 222A and provided as a cartridge (process cartridge).

The exposure device 236 employs a self-scanning LED printhead. Alternatively, the exposure device 236 may be an optical exposure device that exposes the photoconductor 232 to light emitted from a light source and provided via a polygon mirror.

The exposure device 236 forms a latent image on the basis of image signals sent from the controller 400. Examples of the image signals sent from the controller 400 include image signals that the controller 400 obtains from an outer device.

The developing device 238 includes a development roller 238A (an example of the developer carrier), which carries a developer on its surface, supplies the developer to the photoconductor 232, and develops an electrostatic latent image formed on the photoconductor 232, to form a toner image; and plural transport members 238B, which stir and simultaneously transport the developer applied to the development roller 238A.

The photoconductor cleaning device 240 includes the blade 240A, which is in contact with the photoconductor 232 to clean off the residual toner remaining on the photoconductor 232.

The blade 240A has a recess 240C (refer to FIGS. 2A and 2B), which receives the external additive and formed, in a tip surface 240B of the blade 240A facing the photoconductor 232, at a surface portion that is not in contact with the photoconductor 232 (in other words, the surface portion extends in the thickness direction of the blade 240A so as to further separate from the photoconductor 232 with respect to a surface portion in contact with the photoconductor 232), but comes into contact with the photoconductor 232 when the contact area of the blade 240A with respect to the photoconductor 232 increases.

In other words, the recess 240C of the blade 240A is formed, in the tip surface 240B of the blade 240A facing the photoconductor 232, at a portion where, at the time of an increase (in the peripheral direction of the photoconductor 232) in the contact area (contact width) of the blade 240A with respect to the photoconductor 232, the opening of the recess 240C at least partially faces the surface of the photoconductor 232.

Figure 3:
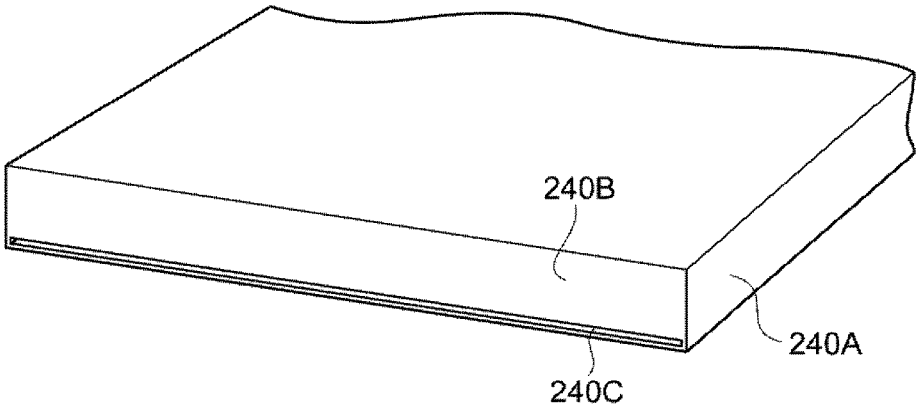
FIG. 3 is a schematic perspective view of a blade of a photoconductor cleaning device in an image forming apparatus according to an exemplary embodiment.
Figure 4:
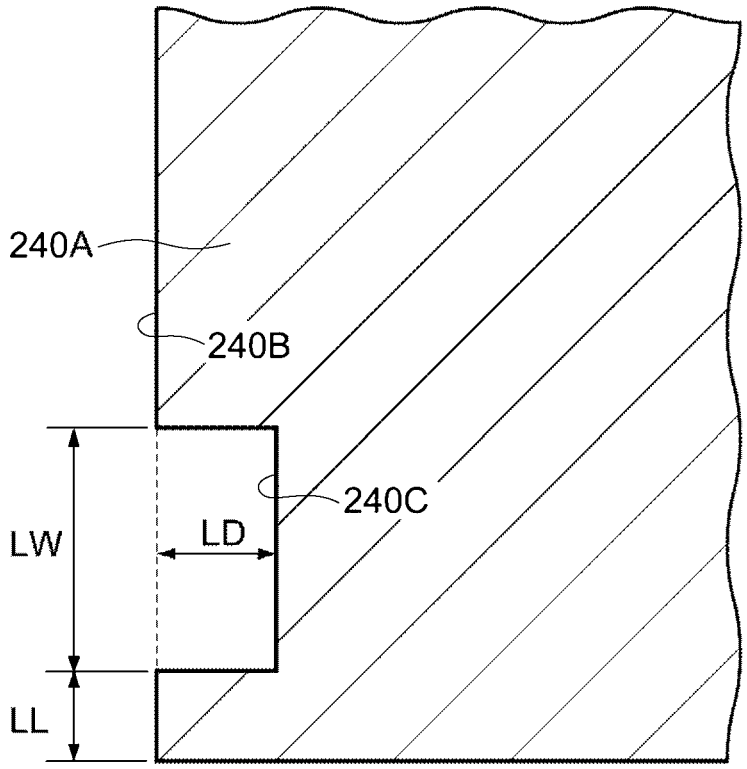
FIG. 4 is a partial sectional view of a blade of a photoconductor cleaning device in an image forming apparatus according to an exemplary embodiment.

Specifically, as illustrated in FIG. 3 and FIG. 4, the recess 240C of the blade 240A is formed, in the state of not being in contact with the photoconductor 232, in a region of the tip surface 240B (the region being close to a corner portion of the tip surface 240B in contact with the photoconductor 232) so as to extend in the blade width direction (longitudinal direction).

The recess 240C of the blade 240A is formed in the tip surface 240B of the blade so as to correspond to a region of the surface of the photoconductor 232 (cleaned by the blade), the region extending from one end to the other end in the axial direction of the photoconductor 232.

A width LW of the recess 240C of the blade 240A (length, in the blade thickness direction, between the ends of the opening of the recess 240C) is, for example, 5 μm or more and 500 μm or less (preferably 20 μm or more and 300 μm or less).

A depth LD of the recess 240C of the blade 240A (length, in a direction perpendicular to an imaginary plane extending along the tip surface 240B of the blade 240A, between the imaginary plane and the deepest portion of the bottom surface of the recess 240C) is, for example, 5 μm or more and 500 μm or less (preferably 20 μm or more and 200 μm or less).

A length LL (length in the blade thickness direction) between an end of the opening of the recess 240C of the blade 240A (the end being close to a corner portion to be in contact with the photoconductor 232) and the tip of the corner portion of the tip surface 240B of the blade 240A (the corner portion to be in contact with the photoconductor 232) is, for example, 5 μm or more and 200 μm or less (preferably 10 μm or more and 100 μm or less).

Incidentally, these dimensions of the recess 240C of the blade 240A are those measured in a state where the blade 240A is not in contact with the photoconductor 232.

The intermediate transfer belt 224 is formed in a loop shape and disposed above the image forming units 222Y to 222K. On the inner peripheral side of the intermediate transfer belt 224, there are tension rollers 242 and 244 and a counter roller 328 (of the toner supply device 320), round which the intermediate transfer belt 224 is stretched. The intermediate transfer belt 224 is circulated (rotated) in a single direction (for example, a counterclockwise direction in FIG. 1) while being in contact with the photoconductor 232, due to rotational driving of one of the tension rollers 242 and 244. Incidentally, the tension roller 242 is disposed as a counter roller facing the second transfer roller 228.

The first transfer roller 226 faces the photoconductor 232 with the intermediate transfer belt 224 therebetween. The region between the first transfer roller 226 and the photoconductor 232 is a first transfer site where the toner image formed on the photoconductor 232 is transferred onto the intermediate transfer belt 224.

The second transfer roller 228 faces the tension roller 242 with the intermediate transfer belt 224 therebetween. The region between the second transfer roller 228 and the tension roller 242 is a second transfer site where the toner image transferred onto the intermediate transfer belt 224 is transferred onto a recording medium P.

The intermediate-transfer-belt cleaning device 310 includes a housing 312 and a blade 314, which cleans the residual toner off the intermediate transfer belt 224. The blade 314 is supported by the housing 312.

Incidentally, such a member that cleans the residual toner off the intermediate transfer belt 224 is not limited to the blade 314, and may be another well-known cleaning member such as a brush.

The toner supply device 320 includes a housing 322; a container 324, which stores the residual toner having been cleaned off from the intermediate-transfer-belt cleaning device 310; a supply roller 326 (an example of the supply part), which supplies the residual toner stored in the container 324 onto the intermediate transfer belt 224; and the counter roller 328, which faces the supply roller 326 with the intermediate transfer belt 224 therebetween. Within the container 324 of the toner supply device 320, there is a stirring member 330 such as an agitator.

The housing 322 of the toner supply device 320 and the housing 312 of the intermediate-transfer-belt cleaning device 310 are integrated. The housing 322 of the toner supply device 320 is in communication with an exit passage 334, through which the residual toner is passed and which is formed in the housing 312 of the intermediate-transfer-belt cleaning device 310. The residual toner cleaned off by the blade 314 is passed through the exit passage 334 and is stored in the container 324 of the toner supply device 320. The residual toner stored in the container 324 is stirred by the stirring member 330.

The supply roller 326 and the counter roller 328 of the toner supply device 320 are constituted by, for example, metal rollers or metal rollers that have a resistance adjustment layer thereon. For example, a voltage of a polarity opposite to the charging polarity of the toner is applied to the supply roller 326 with a power supply (not shown) such that the residual toner being stirred by the stirring member 330 in the container 324 is made to adhere to the surface of the supply roller 326.

The residual toner is moved by the rotation of the supply roller 326 to a position where it faces the intermediate transfer belt 224. At this time, a voltage of a polarity opposite to the charging polarity of the toner is applied from the power supply (not shown) to the counter roller 328, the voltage being higher than the voltage applied to the supply roller 326. As a result, an electric field formed by the voltage causes the residual toner to electrostatically move to the intermediate transfer belt 224.

In the above-described manner, the toner supply device 320 supplies the residual toner onto the intermediate transfer belt 224.

However, the toner supply device 320 is not limited to the above-described configuration, and may be another device as long as it supplies the residual toner onto the intermediate transfer belt 224. Examples of the other device include well-known devices such as devices employing a belt, a brush, or the like, and devices that sprinkle the residual toner.

The toner supply device 320 and the intermediate-transfer-belt cleaning device 310 may be provided as separate devices. In this case, the toner supply device 320 and the intermediate-transfer-belt cleaning device 310 are connected to each other via, for example, a transport pipe that transports the residual toner. The residual toner cleaned off by the blade 314 is transported through, for example, the transport pipe, and stored in the container 324 of the toner supply device 320.

The transport section 216 includes a pick-up roller 246, which picks up a recording medium P stored in the storage section 212; a transport path 248, through which the recording medium P picked up by the pick-up roller 246 is transported; and plural transport rollers 250, which are disposed along the transport path 248 and transport the recording medium P picked up by the pick-up roller 246 to the second transfer site.

At a downstream position in the transport direction with respect to the second transfer site, there is a fixing device 260, which fixes a toner image on the recording medium P, the toner image having been formed on the recording medium P by the image forming section 214.

The fixing device 260 includes a heat roller 264, which heats the image on the recording medium P, and a pressure roller 266, which is an example of the press member. Within the heat roller 264, there is a heat source 264B.

At a downstream position in the transport direction with respect to the fixing device 260, there are output rollers 252, which output the recording medium P on which the toner image has been fixed, to the output section 218.

Control System

Figure 5:
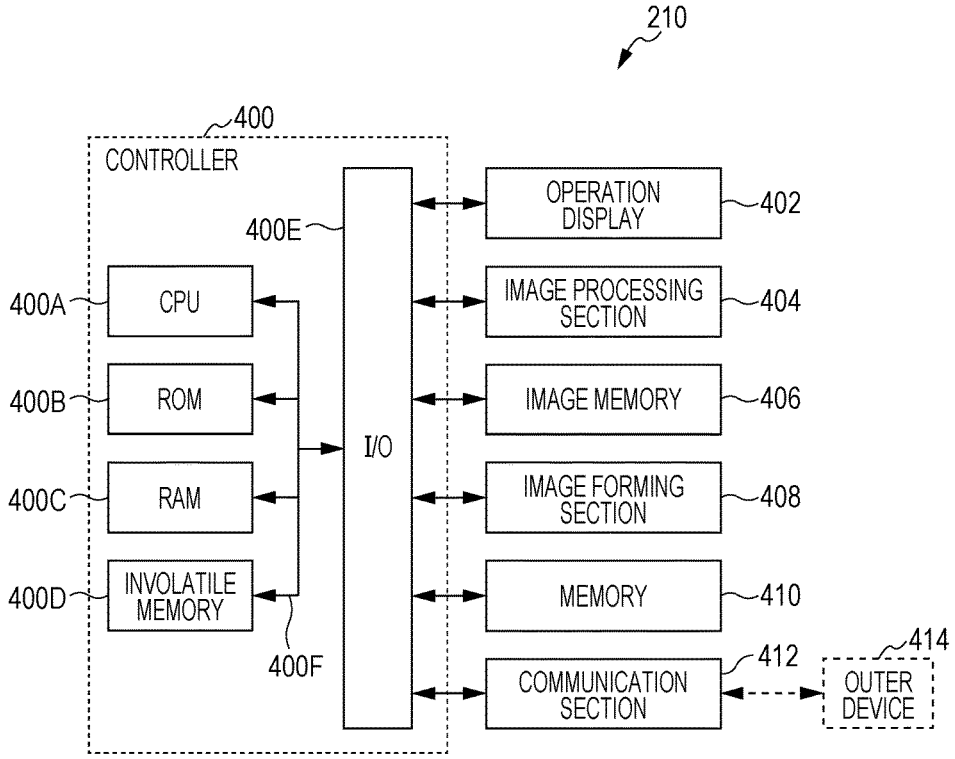
FIG. 5 is a block diagram of a control system in an image forming apparatus according to an exemplary embodiment.

Hereinafter, referring to FIG. 5, an example of the configuration of the control system of the image forming apparatus 210 will be described.

The image forming apparatus 210 includes the controller 400, which controls operations of components (devices, sections, and the like).

The controller 400 is constituted by a computer that controls the whole apparatus and performs various mathematical operations. Specifically, as illustrated in FIG. 5, the controller 400 includes a CPU (Central Processing Unit) 400A; a ROM (Read Only Memory) 400B, which stores various programs; a RAM (Random Access Memory) 400C, which is used as a work area during execution of programs; an involatile memory 400D, which stores various pieces of information; and an input/output interface (I/O) 400E. The CPU 400A, the ROM 400B, the RAM 400C, and the involatile memory 400D are connected to the I/O 400E via a bus 400F.

The image forming apparatus 210 includes, outside of the controller 400, an operation display 402, an image processing section 404, an image memory 406, an image forming section 408, a memory 410, and a communication section 412. The operation display 402, the image processing section 404, the image memory 406, the image forming section 408, the memory 410, and the communication section 412 are connected to the I/O 400E of the controller 400. The controller 400 sends information to or receives information from the operation display 402, the image processing section 404, the image memory 406, the image forming section 408, the memory 410, and the communication section 412, and controls these components.

The operation display 402 is constituted by, for example, various buttons such as a start button and a numeric keypad, and a touch panel that displays various screens such as a warning screen and a setting screen. The operation display 402 having such a configuration receives inputs from the user and displays various pieces of information to the user.

The image processing section 404 performs predetermined image processing to image information obtained from an outer device 414 via the communication section 412, to thereby form image information to be output to the image forming section 408. For example, PDL data described with a page description language is developed and converted into raster data (RGB data) represented by RGB colors; and the RGB data is subjected to color conversion to generate, for example, YMCK data represented by colors to be reproduced in the image forming apparatus. Furthermore, processing such as screen processing or gamma correction processing may be performed.

The image memory 406 stores various pieces of image information acquired by the image forming apparatus 210, such as image information acquired from the outer device 414 and image information generated in the image processing section 404. For example, the image memory 406 at least stores image information having been subjected to image processing of the image processing section 404, in other words, the image information to be output to the image forming section 408.

The image forming section 408 is that is described above as a part of the image forming apparatus 210. The image forming section 408 includes, for example, the image forming section 214 [the image forming units 222Y to 222K, the transfer device (unit constituted by the intermediate transfer belt 224, the first transfer rollers 226, and the second transfer roller 228), and the toner supply device 320], the transport section 216, the output section 218, and the fixing device 260. These components are connected to the controller 400. The controller 400 sends information to or receives information from the components and controls the components.

The memory 410 includes a storage device such as a hard disk. The memory 410 stores various data items such as log data and various programs, for example.

The communication section 412 is an interface for communication with the outer device 414 via a wire or wireless communication channel. For example, the communication section 412 acquires, from the outer device 414, image forming instructions or image information for an electronic document as well as image forming information. The image forming information includes parameters representing properties such as the type of recording media P (for example, size), the feeding direction of the recording media P, the number of copies, and the color mode.

Incidentally, various drives may be connected to the controller 400. These various drives are devices that read data from or write data to computer-readable portable recording media, such as flexible disks, magneto-optical disks, CD-ROMs, DVD-ROMs, and USB memory devices. When such a drive is provided, control programs may be stored in a portable recording medium, and the programs may be read with a corresponding drive and executed.

Operations of Image Forming Apparatus

An example of operations of the image forming apparatus 210 according to this exemplary embodiment will be described. Incidentally, various operations of the image forming apparatus 210 are performed by control programs executed in the controller 400.

In the image forming apparatus 210, control programs such as an "image forming process" and a "residual toner supply process" are stored in advance in the ROM 400B. The control programs stored in advance are read out by the CPU 400A and executed in the RAM 400C as a work area. In the image forming apparatus 210, for example, the involatile memory 400D stores in advance various data items such as a "range of area coverage of a toner image in which residual toner supply operations by the toner supply device 320 and the image forming unit 222 are started (hereafter, also simply referred to as the "range of area coverage of a toner image in which residual toner supply operations are started")"; a "range of area coverage of a toner image in which residual toner supply operations by the toner supply device 320 and the image forming unit 222 are stopped (hereafter, also simply referred to as the "range of area coverage of a toner image in which residual toner supply operations are stopped")"; "residual toner supply process conditions"; and "image forming conditions (various process control values)".

These control programs and various data items may be stored in the ROM 400B, the involatile memory 400D, or another storage device such as the memory 410, or may be acquired from an outer source via the communication section 412.

An example of image forming operations of the image forming apparatus 210 will be described. The image forming operations are performed by the control program "image forming process" executed in the controller 400.

In the image forming apparatus 210, a recording medium P picked up from the storage section 212 by the pick-up roller 246 is first transported by plural transport rollers 250 to the second transfer site.

On the other hand, in each of the image forming units 222Y to 222K, the photoconductor 232 charged by the charging device 223 is exposed by the exposure device 236 to form an electrostatic latent image on the photoconductor 232. The electrostatic latent image is developed by the developing device 238 to form a toner image on the photoconductor 232. Such toner images of the colors formed in the image forming units 222Y to 222K are stacked at the first transfer sites onto the intermediate transfer belt 224, to form a color image. The color image formed on the intermediate transfer belt 224 is transferred at the second transfer site onto the recording medium P.

The recording medium P onto which the toner image has been transferred, is transported to the fixing device 260, and the transferred toner image is fixed by the fixing device 260. The recording medium P on which the toner image has been fixed, is output by the output rollers 252 to the output section 218. In the above-described manner, a series of image forming operations is performed.

On the other hand, in the image forming apparatus 210, while the image forming operations are performed, the controller 400 performs the following control (control of start and stop of residual toner supply operations). When a toner image having a predetermined area coverage or less is formed on the photoconductor 232 of the image forming unit 222 (in other words, when the area coverage of the toner image is a predetermined value or less), operations are started that are "supply of the residual toner onto the intermediate transfer belt 224" by the toner supply device 320 and "movement of the residual toner on the intermediate transfer belt 224 to the photoconductor 232" by the image forming unit 222 forming a toner image having a predetermined area coverage or less. On the other hand, when a toner image of more than the predetermined area coverage is formed on the photoconductor 232 of the image forming unit 222 (in other words, when the area coverage of the toner image is more than the predetermined value), the operations are stopped that are the "supply of the residual toner onto the intermediate transfer belt 224" by the toner supply device 320 and the "movement of the residual toner on the intermediate transfer belt 224 to the photoconductor 232" by the image forming unit 222 forming a toner image having the predetermined area coverage or less.

The residual toner supply operations will be described. The residual toner supply operations are performed by the control program "residual toner supply process" executed in the controller 400. The control program "residual toner supply process" is started in response to, for example, image forming instructions from the operation display 402 or the outer device 414 via the communication section 412.

Incidentally, the "residual toner supply process" is performed for each of the image forming units 222Y to 222K. As a result, when a toner image having a predetermined area coverage or less is formed on the photoconductor 232 of at least one image forming unit 222 among the image forming units 222Y to 222K, the residual toner supply operations are performed, so that the residual toner stored in the container 324 of the toner supply device 320 is supplied to the contact region between the photoconductor 232 and the blade 240A of the image forming unit 222 in which the toner image having the predetermined area coverage or less is formed.

Figure 6:
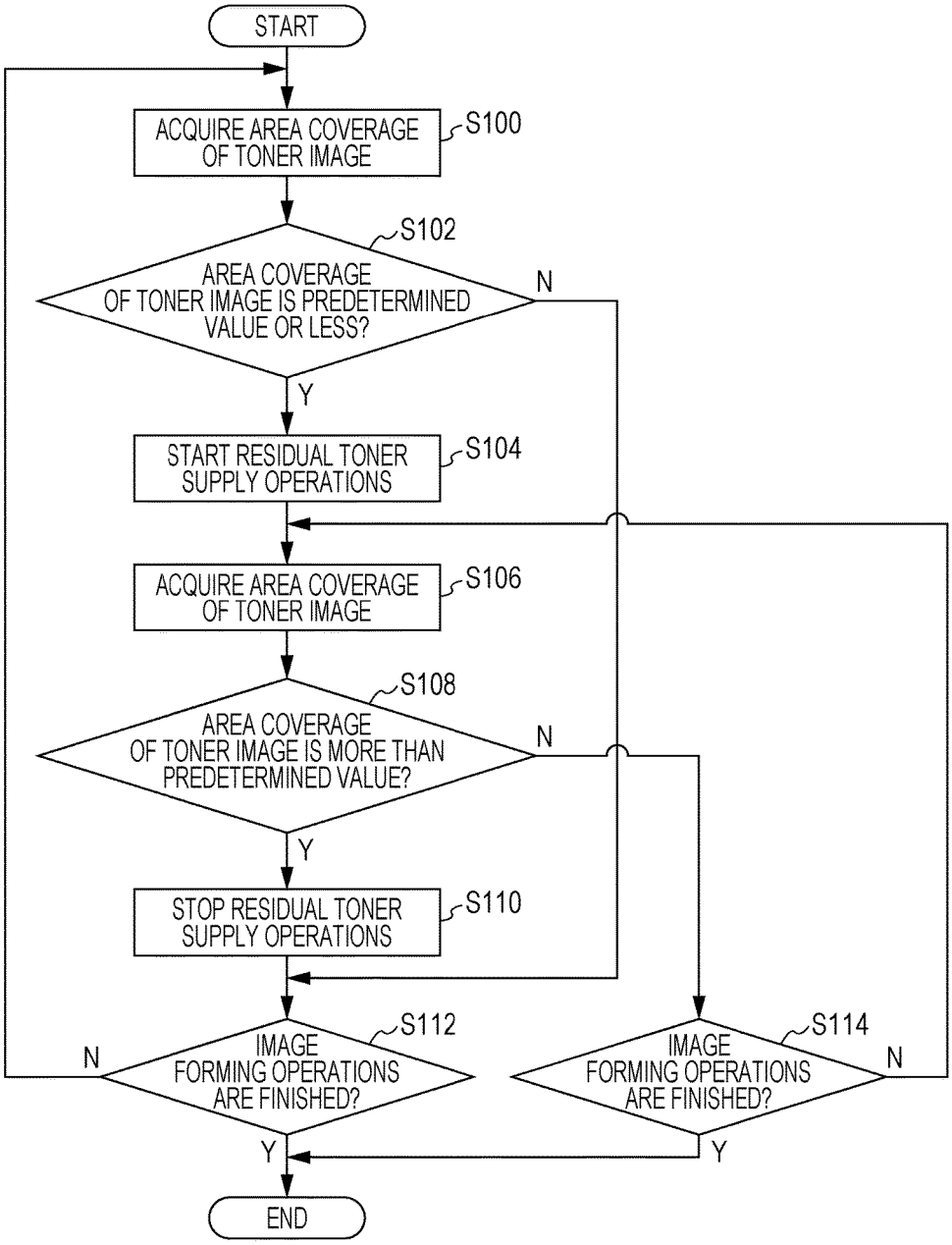
FIG. 6 is a flowchart illustrating an example of procedures of a "residual toner supply process"

As illustrated in FIG. 6, in Step S100, the area coverage of a toner image to be formed on the photoconductor 232 of the image forming unit 222 is first acquired.

The method of acquiring the area coverage is not particularly limited, and examples of the method include a method of acquiring an area coverage determined on the basis of image data obtained by reading a toner image formed on a recording medium P with a reading device (not shown), and a method of acquiring an area coverage determined on the basis of the image information of an image to be formed.

Subsequently, in Step S102, it is determined whether or not the acquired area coverage of the toner image is a predetermined value or less.

Specifically, for example, the "range of the area coverage of the toner image in which residual toner supply operations are started" stored in advance in the involatile memory 400D is acquired, and this range of the area coverage of the toner image is compared with the acquired area coverage of the toner image.

Incidentally, the "range of the area coverage of the toner image in which residual toner supply operations are started" is, for example, an area coverage of 5% or less (preferably 2% or less). In this range of the area coverage, the amount of toner consumed in the developer stored in the developing device 238 decreases, and the same toner remains within the developing device 238; as a result, embedding of the external additive in the toner particles tends to occur, and the amount of external additive dam tends to decrease.

When the determination at Step S102 is negative (when the acquired area coverage of the toner image is more than the predetermined value, in other words, when the acquired area coverage of the toner image is determined to be out of the "range of the area coverage of the toner image in which residual toner supply operations are started"), the routine proceeds to Step S112.

On the other hand, when the determination at Step S102 is affirmative (when the acquired area coverage of the toner image is the predetermined value or less, in other words, when the acquired area coverage of the toner image is determined to be within the "range of the area coverage of the toner image in which residual toner supply operations are started"), the routine proceeds to Step S104.

Subsequently, in Step S104, on the basis of the "residual toner supply process conditions" stored in advance in the involatile memory 400D, residual toner supply operations are started.

Specifically, the toner supply device 320 is operated to supply the residual toner onto the intermediate transfer belt 224. Subsequently, the image forming unit 222 is operated such that a voltage of a polarity opposite to that of a voltage applied for transferring the toner from the photoconductor 232 to the intermediate transfer belt 224, is applied to the first transfer roller 226. As a result, the residual toner is transferred at the first transfer site from the intermediate transfer belt 224 to the photoconductor 232. As the photoconductor 232 rotates, the residual toner is supplied to the contact region between the photoconductor 232 and the blade 240A.

The amount of residual toner supplied by the toner supply device 320 onto the intermediate transfer belt 224 is, for example, 2 g/m$^2$ or more and 12 g/m$^2$ or less.

Subsequently, in Step S106, the area coverage of a toner image to be formed on the photoconductor 232 of the image forming unit 222 is acquired.

Subsequently, in Step S108, it is determined whether or not the acquired area coverage of the toner image is more than a predetermined value.

Specifically, for example, the "range of the area coverage of the toner image in which the residual toner supply operations are stopped" stored in advance in the involatile memory 400D is acquired, and this range of the area coverage of the toner image is compared with the acquired area coverage of the toner image.

Incidentally, the "range of the area coverage of the toner image in which the residual toner supply operations are stopped" is, for example, an area coverage of more than 5% (preferably more than 2%). In this range of the area coverage, the amount of toner consumed in the developer stored in the developing device 238 increases, and the same toner tends not to remain within the developing device 238; as a result, the toner tends not to deteriorate and a decrease in the amount of external additive dam tends not to occur.

When the determination at Step S108 is negative (when the acquired area coverage of the toner image is the predetermined value or less, in other words, when the acquired area coverage of the toner image is determined to be out of the "range of the area coverage of the toner image in which the residual toner supply operations are stopped"), the routine proceeds to Step S114.

On the other hand, when the determination at Step S108 is affirmative (when the acquired area coverage of the toner image is more than the predetermined value, in other words, when the acquired area coverage of the toner image is determined to be within the "range of the area coverage of the toner image in which the residual toner supply operations are stopped"), the routine proceeds to Step S110.

Subsequently, in Step S110, the residual toner supply operations are stopped.

In Step S112, it is determined whether or not the image forming operations are finished. In Step S112, when the finish of the image forming operations is determined to be negative, the routine returns to Step S100. On the other hand, when the finish of the image forming operations is determined to be affirmative in Step S112, the routine ends.

On the other hand, in Step S114, it is also determined whether or not the image forming operations are finished. In Step S114, when the finish of the image forming operations is determined to be negative, the routine returns to Step S106. On the other hand, in Step S114, when the finish of the image forming operations is determined to be affirmative, the routine ends.

In the above-described "residual toner supply process", when a toner image having a predetermined area coverage or less is formed on the photoconductor 232 of the image forming unit 222, the toner supply device 320 is used to supply a residual toner onto the intermediate transfer belt 224. Subsequently, the image forming unit 222 is used to move the residual toner on the intermediate transfer belt 224 to the photoconductor 232, and to supply the residual toner to the contact region between the photoconductor 232 and the blade 240A. As a result of these operations, even when an image having a low area coverage (for example, an area coverage of 5% or less) is repeatedly formed in an environment at a high temperature and a high humidity and the amount of toner consumed decreases, the amount of toner supplied to the contact region between the photoconductor 232 and the blade 240A is ensured. Thus, the conditions of the external additive dam (the area ratio of the organic component to the inorganic component, and the area ratio of the inorganic component that is spherical to the external additive dam) tend to be maintained. Thus, an increase in the coefficient of friction between the image carrier and the blade is suppressed, and the instability of the position of the blade with respect to the image carrier is suppressed. As a result, the conditions of the external additive dam tend to be maintained, and the "local wear in the blade for the image carrier", which occurs during repeated formation of an image having a low area coverage in an environment at a high temperature and a high humidity, tends to be suppressed.

Developer

Hereinafter, the developer stored in the developing device 238 will be described.

The developer contains a toner and a carrier. Alternatively, the developer may be a mono-component developer containing a toner only.

The toner contains toner particles having a volume-average particle size of 3 μm or more and 5 μm or less (preferably 3.5 μm or more and 4.5 μm or less), and an external additive having a number-average particle size of 80 nm or more and 200 nm or less (preferably 100 nm or more and 200 nm or less).

The mixing ratio (mass ratio) of the toner to the carrier (toner:carrier) is preferably 1:100 to 30:100, more preferably 3:100 to 20:100.

Incidentally, the volume-average particle size of the toner particles is measured with a COULTER MULTISIZER II (manufactured by Beckman Coulter, Inc.) and with an electrolyte that is ISOTON-II (manufactured by Beckman Coulter, Inc.).

In the measurement, to 2 ml of a 5% aqueous solution of a surfactant (preferably, sodium alkylbenzene sulfonate) as a dispersing agent, a measurement sample (0.5 mg or more and 50 mg or less) is added. The resultant solution is added to the electrolyte (100 ml or more and 150 ml or less).

The electrolyte in which the sample has been suspended is subjected to dispersion treatment for 1 minute with an ultrasonic dispersing device. The COULTER MULTISIZER II is used to measure the particle size distribution of particles having a particle size in the range of 2 μm or more and 60 μm or less, through an aperture having an aperture size of 100 μm. The number of particles sampled is 50000.

The measured particle size distribution is divided into particle-size ranges (channels). Over these channels, a cumulative curve of the volume of the particles is drawn from smaller to larger particle sizes. The particle size corresponding to a cumulative amount of 50% is defined as volume-average particle size D50v.

On the other hand, the number-average particle size of the external additive is measured in the following manner. The external additive is first externally added to toner particles, and 100 primary particles of metal oxide particles (toner) are observed with an SEM (Scanning Electron Microscope) system. The image of the primary particles is analyzed to measure the maximum size and the minimum size of each particle. On the basis of the middle value between these sizes, an equivalent sphere diameter is determined. The obtained equivalent sphere diameters are analyzed in terms of cumulative distribution based on number of the particles, and the 50% diameter (D50p) is defined as the number-average particle size of the external additive.

Toner Particles

The toner particles contain a binder resin, for example. The toner particles may optionally contain a coloring agent, a release agent, and other additives.

Examples of the binder resin include vinyl resins that are homopolymers of the following monomers listed as examples and copolymers of two or more selected from these monomers: styrenes (for example, styrene, para-chlorostyrene, and α-methylstyrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene).

Other examples of the binder resin include non-vinyl resins such as epoxy resins, polyester resins, polyurethane resins, polyamide resins, cellulose resins, polyether resins, and modified rosin; mixtures of such a non-vinyl resin and a vinyl resin described above; and graft polymers obtained by polymerizing a vinyl monomer in the presence of such a non-vinyl resin.

These binder resins may be used alone or in combination of two or more thereof.

The binder resin content relative to the total mass of the toner particles is, for example, preferably 40 mass % or more and 95 mass % or less, more preferably 50 mass % or more and 90 mass % or less, still more preferably 60 mass % or more and 85 mass % or less.

Examples of the coloring agent include various pigments such as carbon black, chrome yellow, Hansa yellow, benzidine yellow, threne yellow, quinoline yellow, pigment yellow, permanent orange GTR, pyrazolone orange, Vulcan orange, Watchung red, permanent red, brilliant carmine 3B, brilliant carmine 6B, Dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These coloring agents may be used alone or in combination of two or more thereof.

Such a coloring agent may be a coloring agent that is surface-treated, or may be used in combination with a dispersing agent. Plural coloring agents may be used in combination.

The coloring agent content relative to the total mass of the toner particles is, for example, preferably 1 mass % or more and 30 mass % or less, more preferably 3 mass % or more and 15 mass % or less.

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic esters. However, the release agent is not limited to these examples.

The release agent content relative to the total mass of the toner particles is, for example, preferably 1 mass % or more and 20 mass % or less, more preferably 5 mass % or more and 15 mass % or less.

Examples of the other additives include well-known additives such as magnetic substances, charge control agents, and inorganic powders. Such additives are contained, as internal additives, in toner particles.

The toner particles may be toner particles having a monolayer structure, or may be toner particles having, what is called, a core-shell structure constituted by a core (core particle) and a cover layer (shell layer) covering the core.

Such toner particles having a core-shell structure are preferably constituted by, for example, a core containing a binder resin and optionally other additives such as a coloring agent and a release agent, and a cover layer containing a binder resin.

The toner particles preferably have an average circularity of 0.94 or more and 1.00 or less, more preferably 0.95 or more and 0.98 or less.

The average circularity of toner particles is calculated by (circumferential length of equivalent circle)/(peripheral length) [(circumferential length of a circle having the same projection area as the image of a particle)/(peripheral length of the projected image of the particle)]. Specifically, the average circularity is calculated in the following manner.

The average circularity is determined with a flow particle image analyzer (FPIA-3000, manufactured by SYSMEX CORPORATION) in which the toner particles to be measured are first taken in by suction; the toner particles are made to form a flat flow; the flat flow is exposed to light emitted for a very short period from a stroboscope and still pictures are taken as images of the particles; and the images of the particles are subjected to image analysis. In the determination of the average circularity, the number of the particles sampled is 3500.

Incidentally, when the toner contains an external additive, the toner (developer) to be measured is dispersed in water containing a surfactant and subsequently subjected to ultrasonic treatment, to thereby provide toner particles from which the external additive has been removed.

External Additive

Examples of the external additive include inorganic particles. The inorganic particles may be formed of, for example, $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, or $MgSO_4$.

The inorganic particles as an external additive may be subjected to hydrophobic treatment so as to have hydrophobic surfaces. The hydrophobic treatment may be performed by, for example, immersing the inorganic particles in a hydrophobic treatment agent. The hydrophobic treatment agent is not particularly limited and examples thereof include silane coupling agents, silicone oil, titanate coupling agents, and aluminum coupling agents. These hydrophobic treatment agents may be used alone or in combination of two or more thereof.

The amount of hydrophobic treatment agent is normally, for example, relative to 100 parts by mass of the inorganic particles, 1 part by mass or more and 10 parts by mass or less.

Other examples of the external additive include resin particles (resin particles formed of, for example, polystyrene, polymethyl methacrylate (PMMA), or melamine resin), and cleaning active agents (for example, metallic salts of higher fatty acids represented by zinc stearate, and particles of fluoropolymers).

The amount of external additive externally added relative to the toner particles is, for example, preferably 0.01 mass % or more and 5 mass % or less, more preferably 0.01 mass % or more and 2.0 mass % or less.

Method for Producing Toner

Hereinafter, a method for producing the toner will be described.

The toner is obtained by producing the toner particles and then externally adding the external additive to the toner particles.

The toner particles may be produced by a dry process (for example, a kneading-pulverization process) or a wet process (for example, an aggregation-coalescence process, a suspension polymerization process, or a dissolution-suspension process). However, the method for producing the toner particles is not particularly limited to these processes, and may be selected from well-known processes. Among the above-described processes, the aggregation-coalescence process is preferably employed to produce the toner particles.

The toner is produced by, for example, adding the external additive to the obtained toner particles in a dry state, and mixing the resultant mixture. This mixing may be performed with, for example, a V blender, a HENSHEL MIXER, or a Loedige mixer. In addition, optionally, coarse particles may be removed from the toner with, for example, a vibratory sifter or a pneumatic sifter.

Carrier

The carrier is not particularly limited and may be selected from known carriers. Examples of the carrier include a covered carrier in which the surfaces of cores of a magnetic powder are covered with a cover resin; a magnetic powder dispersed carrier in which a magnetic powder is added so as to be dispersed in a matrix resin; and a resin impregnated carrier in which a porous magnetic powder is impregnated with a resin.

Incidentally, each of the magnetic powder dispersed carrier and the resin impregnated carrier may also be a covered carrier in which cores that are the particles of the carrier are covered with a cover resin.

Examples of the material of the magnetic powder include magnetic metals such as iron, nickel, and cobalt and magnetic oxides such as ferrite and magnetite.

Examples of the cover resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing organosiloxane bonds or modified resins thereof, fluororesins, polyester, polycarbonate, phenolic resins, and epoxy resins.

Incidentally, the cover resin and the matrix resin may contain other additives such as conductive particles.

The conductive particles may be particles of, for example, a metal such as gold, silver, or copper, carbon black, titanium oxide, zinc oxide, tin oxide, barium sulfate, aluminum borate, or potassium titanate.

The process of covering the surfaces of cores with a cover resin may be performed by, for example, dissolving the cover resin and optionally some additives in an appropriate solvent to prepare a cover-layer-forming solution and by covering the cores with this solution. The solvent is not particularly limited and may be selected in accordance with, for example, the cover resin used and the coatability.

Specific examples of the covering process with a resin include an immersion process of immersing cores in the cover-layer-forming solution; a spraying process of spraying the cover-layer-forming solution to the surfaces of cores; a fluidized bed process of spraying the cover-layer-forming solution to cores being floated with fluidizing air; and a kneader-coater process of mixing, within a kneader-coater, the cores of a carrier and the cover-layer-forming solution and removing the solvent.

The carrier preferably has a volume-average particle size of 20 μm or more and 35 μm or less, preferably 25 μm or more and 33 μm or less.

The volume-average particle size of the carrier is determined in the following manner. A laser diffraction/scattering particle size analyzer (LS Particle Size Analyzer, manufactured by Beckman Coulter, Inc.) is used to measure the particle size distribution of the carrier. An electrolyte, ISOTON-II (manufactured by Beckman Coulter, Inc.), is used. The number of particles measured is 50,000.

The measured particle size distribution of the carrier is divided into particle size ranges (channels). Over these channels, a cumulative curve of the volume of the particles is drawn from smaller to larger particle sizes. The particle size corresponding to a cumulative amount of 50% (referred to as "D50v") is defined as the "volume-average particle size".

TEST EXAMPLES

Hereinafter, test examples will be described, the test examples demonstrating that the image forming apparatus 210 according to this exemplary embodiment suppresses the "local wear in the blade for the image carrier".

Preparation of Developer

Toners are each prepared in the following manner. Black toner particles (polyester, 100 parts by mass) having a volume-average particle size D50v in Table 1 or 2, a spherical inorganic external additive (hydrophobic silica particles, 1.5 parts by mass, a circularity of 0.91) having a number-average particle size D50p in Table 1, and an external additive (Zinc Stearate particles, volume average particle size: 1.5 μm), as an organic component, the content of which is shown in Table 1, are mixed using a sample mill at 10000 rpm for 30 seconds. The resultant mixture is sifted with a vibratory sifter with an opening size of 45 μm. Thus, the toners are prepared.

The toners (each 4 parts) and carriers (each 96 parts) prepared, by a production method described below, with ferrite particles having different particle sizes so as to have volume-average particle sizes D50v in Table 1 and Table 2, are stirred with a V-blender at 40 rpm for 20 minutes, and sifted through sieves having an opening size of 250 μm. Thus, Developers D1 to D10 are prepared.

Method for Producing Carrier

Ferrite particles (average particle size: 35 μm): 100 parts

Toluene: 14 parts

Styrene-methyl methacrylate copolymer (unit ratio: 90/10): 2 parts

Carbon black (R330, manufactured by Cabot Corporation): 0.2 parts

The components other than the ferrite particles are first stirred with a stirrer for 10 minutes, to prepare a cover-forming solution (dispersion). This cover-forming solution and the ferrite particles are placed into a vacuum-degassing kneader, stirred at 60° C. for 30 minutes, then subjected to heating and simultaneously a reduced pressure to achieve degassing, and dried. Thus, Carrier 1 is produced.

Test Example A

A DocuCentre-V C7775 manufactured by Fuji Xerox Co., Ltd. is modified by attaching the blade for a photoconductor in FIG. 3 and FIG. 4 (blade having, in its tip surface, a recess having a width LW of 200 μm, a depth LD of 100 μm, and a length LL of 30 μm).

Into the developing device and the toner cartridge of the modified apparatus, each of Developers D1 to D10 is charged and the following test is performed.

In an environment at a high temperature and a high humidity (environment at 30° C. and 85% RH), an image having a pattern in FIG. 7 (a single line image pattern) is output with a toner application amount of 3.5 g/m$^2$ and an area coverage of 1% on 1000 sheets of A4-size paper.

The same image formation is performed except that another blade having no recess in the tip surface is attached.

Subsequently, an external additive dam is sampled from the contact region between the photoconductor and the blade. In the above-described manner, the "area ratio of the organic component to the inorganic component (organic component/inorganic component)" in the external additive dam and the "area ratio of the inorganic component that is spherical to the external additive dam" are measured.

In addition, after the image is output, the image quality of other output images is evaluated in the following manner.

A whole-surface solid image, a whole-surface HT50% image, and a whole-surface blank image are output (10 sheets per image); the number of white streaks and the number of color streaks generated on the images are counted.

Evaluation Grades

A: the number of color or white streaks generated is 0 (cleaning blade (BLD) has no local wear/charging roller (BCR) has no contamination)

B: the number of color streaks generated is 1 or more and 2 or less (color streaks due to local wear in BLD)

C: the number of color streaks generated is 3 or more (color streaks due to local wear in BLD)

D: cleaning is not sufficiently achieved due to escape of the external additive from BLD The results are summarized in Table 1.

TABLE 1

| | Developer | | | | Test A | | | | | |
|---|---|---|---|---|---|---|---|---|---|---|
| | | | | | Blade has recess in tip surface | | | Blade has no recess in tip surface | | |
| | Toner particles D50v (μm) | External additive Silica D50p (nm) | External additive Zinc Stearate (wt %) | Carrier D50v (μm) | External additive dam Area ratio A | External additive dam Area ratio B | Evaluation result of image quality | External additive dam Area ratio A | External additive dam Area ratio B | Evaluation result of image quality |
| D1 | 4.5 | 120 | 0.1 | 35 | 6/4 | 35 | A | 8/2 | 20 | B |
| D2 | 3 | 80 | 0.1 | 35 | 7/3 | 30 | A | 9/1 | 10 | C |
| D3 | 5 | 200 | 0.1 | 35 | 3/7 | 40 | A | 3/7 | 30 | A |
| D4 | 2.8 | 78 | 0.1 | 35 | 8/2 | 20 | B | 9/1 | 10 | C |
| D5 | 5.0 | 210 | 0.1 | 35 | 2/8 | 60 | D | 2/8 | 50 | D |
| D6 | 4.5 | 80 | 0.1 | 35 | 6.5/3.5 | 30 | A | 7.5/2.5 | 25 | B |
| D7 | 3 | 120 | 0.1 | 35 | 6.5/3.5 | 30 | A | 7.5/2.5 | 25 | B |
| D8 | 4.5 | 120 | 0.1 | 45 | 7/3 | 30 | A | 9/1 | 10 | C |
| D9 | 4.5 | 120 | 0.3 | 35 | 8/2 | 20 | B | 9/1 | 10 | C |
| D10 | 4.5 | 120 | 0.01 | 35 | 2/8 | 70 | D | 1/9 | 70 | D |

External additive dam Area ratio A: area ratio of organic component to inorganic component (organic component/inorganic component) in external additive dam
External additive dam Area ratio B: area ratio of inorganic component that is spherical to external additive dam Test Example B A DocuCentre-V C7775 manufactured by Fuji Xerox Co., Ltd. is modified by attaching a device corresponding to the toner supply device 320 in FIG. 1, so that the residual toner can be supplied onto the intermediate transfer belt.

Into the developing device and the toner cartridge of the modified apparatus, each of Developers D1 to D10 is charged and the following test is performed.

In an environment at a high temperature and a high humidity (environment at 30° C. and 85% RH), an image having a pattern in FIG. 7 (a single line image pattern) is output with a toner application amount of 3.5 g/m$^2$ and an area coverage of 1% on 1000 sheets of A4-size paper.

At this time, the following toner supply operations are performed. The toner supply device is used to supply, onto the intermediate transfer belt, the residual toner (in an amount of 3.5 g/m$^2$) so as to have a strip shape and extend in the width direction of the intermediate transfer belt. Onto the surface of the photoconductor having an image thereon, the residual toner on the intermediate transfer belt is moved, to supply the residual toner to the contact region between the photoconductor and the blade.

Another test as in the above-described image formation is also performed except that the toner supply operations are not performed.

After the above-described tests are performed, the "area ratio of the organic component to the inorganic component (organic component/inorganic component) in the external additive dam" and the "area ratio of the inorganic component that is spherical to the external additive dam" are determined. In addition, after the image is output, the image quality of other output images is evaluated.

The results are summarized in Table 2.

TABLE 2

| | Developer | | | | Test B | | | | | |
|---|---|---|---|---|---|---|---|---|---|---|
| | | | | | Toner supply operations are performed | | | Toner supply operations are not performed | | |
| | Toner particles D50v (μm) | External additive D50p (nm) | External additive Zinc Stearate (wt %) | Carrier D50v (μm) | External additive dam Area ratio A | External additive dam Area ratio B | Evaluation result of image quality | External additive dam Area ratio A | External additive dam Area ratio B | Evaluation result of image quality |
| D1 | 4.5 | 120 | 0.1 | 35 | 6/4 | 35 | A | 8/2 | 20 | B |
| D2 | 3 | 80 | 0.1 | 35 | 7/3 | 30 | A | 9/1 | 10 | C |
| D3 | 5 | 200 | 0.1 | 35 | 3/7 | 40 | A | 3/7 | 30 | A |
| D4 | 2.8 | 78 | 0.1 | 35 | 8/2 | 20 | B | 9/1 | 10 | C |
| D5 | 5.0 | 210 | 0.1 | 35 | 2/8 | 60 | D | 2/8 | 50 | D |
| D6 | 4.5 | 80 | 0.1 | 35 | 6.5/3.5 | 30 | A | 7.5/2.5 | 25 | B |
| D7 | 3 | 120 | 0.1 | 35 | 6.5/3.5 | 30 | A | 7.5/2.5 | 25 | B |
| D8 | 4.5 | 120 | 0.1 | 45 | 7/3 | 30 | A | 9/1 | 10 | C |
| D9 | 4.5 | 120 | 0.3 | 35 | 8/2 | 20 | B | 9/1 | 10 | C |
| D10 | 4.5 | 120 | 0.01 | 35 | 2/8 | 70 | D | 1/9 | 70 | D |

External additive dam Area ratio A: area ratio of organic component to inorganic component (organic component/inorganic component) in external additive dam
External additive dam Area ratio B: area ratio of inorganic component that is spherical to external additive dam The above-described results have demonstrated that, in spite of repeated formation of an image having a low area coverage in an environment at a high temperature and a high humidity, a recess formed at a specific portion in the tip surface of the blade enables suppression of local wear of the blade, to thereby suppress generation of streaks on the image.

The above-described results also have demonstrated that, in spite of repeated formation of an image having a low area coverage in an environment at a high temperature and a high humidity, specific toner supply operations performed enable suppression of local wear of the blade, to thereby suppress generation of streaks on the image.

The above-described results also have demonstrated that toner particles and an external additive that satisfy the specific ranges of particle sizes enable suppression of generation of streaks on the image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit including:

an image carrier, a developing device that includes a developer containing a toner and that develops, with the developer, an electrostatic latent image on the image carrier to form a toner image, and a cleaning device including a blade that cleans a residual toner off the image carrier;

a transfer device that transfers the toner image formed on the image carrier onto a recording medium, the transfer device including:

an intermediate transfer member onto a surface of which the toner image is transferred;

a first transfer part that performs first transfer of transferring the toner image formed on a surface of the image carrier of the image forming unit, onto the surface of the intermediate transfer member; and a second transfer part that performs second transfer of transferring the toner image transferred onto the surface of the intermediate transfer member, onto a surface of the recording medium;

an intermediate-transfer-member cleaning device that cleans residual toner off the intermediate transfer member;

a toner supply device including:

a container that stores the residual toner from the intermediate transfer member, and a supply part that supplies the residual toner stored in the container to the intermediate transfer member and to a contact region between the image carrier and the blade in the image forming unit; and a controller that controls a supply operation of the toner supply device when a toner image having a predetermined area coverage or less is formed on the image carrier of the image forming unit, such that, during formation of the toner image having a predetermined area coverage or less, the residual toner in the toner supply device is supplied onto the intermediate transfer member and is moved from the intermediate transfer member to the image carrier of the image forming unit, wherein:

the toner contains toner particles having a volume-average particle size of 3 μm or more and 5 μm or less, a spherical inorganic external additive having a number-average particle size of 80 nm to 200 nm, and an organic component, in the cleaning device, an external additive residue in or near the contact region between the image carrier and the blade contains the organic component and an inorganic component, an area ratio of the organic component to the inorganic component is 3/7 or more and 7/3 or less, and an area ratio of the inorganic component that is spherical to the external additive residue is 30% or more.

2. The image forming apparatus according to claim 1, wherein the organic component is silicone oil attached at the inorganic external additive.

3. The image forming apparatus according to claim 1, wherein the organic component is a lubricant.

4. The image forming apparatus according to claim 3, wherein the lubricant is a metallic salt of a fatty acid.

5. The image forming apparatus according to claim 1, wherein:

the image forming unit includes a plurality of the image forming units, and the controller controls the supply operation of the toner supply device when a toner image having a predetermined area coverage or less is formed on the image carrier of at least one image forming unit of the plurality of image forming units.

6. The image forming apparatus according to claim 1, wherein the toner image having a predetermined area coverage or less is a toner image having an area coverage of 5% or less.

7. The image forming apparatus according to claim 1, wherein the area ratio of the organic component to the inorganic component is 2/3 to 3/2.

8. The image forming apparatus according to claim 1, wherein the area ratio of the inorganic component that is spherical to the external additive residue is 40% or more.

9. An image forming apparatus comprising:

an image forming unit including:

an image carrier, a developing device that includes a developer containing a toner and that develops, with the developer, an electrostatic latent image on the image carrier to form a toner image, and a cleaning device including a blade that cleans a residual toner off the image carrier; and a transfer device that transfers the toner image formed on the image carrier onto a recording medium, wherein:

the toner contains toner particles having a volume-average particle size of 3 μm or more and 5 μm or less, a spherical inorganic external additive having a number-average particle size of 80 nm to 200 nm, and an organic component, in the cleaning device, an external additive residue in or near a contact region between the image carrier and the blade contains the organic component and an inorganic component, an area ratio of the organic component to the inorganic component is 3/7 or more and 7/3 or less, and an area ratio of the inorganic component that is spherical to the external additive residue is 30% or more, and the blade has a recess that receives the external additive, the recess being in a tip surface of the blade at a surface portion that is not in contact with the image carrier but that partially comes into contact with the image carrier when a contact area of the blade with respect to the image carrier increases, the recess having a width of 20 to 300 μm and a depth of 20 to 200 μm, and wherein a distance between the recess and a tip of the blade is 10 to 100 μm.

* * * * *